US010865349B2

(12) United States Patent
Das et al.

(10) Patent No.: US 10,865,349 B2
(45) Date of Patent: Dec. 15, 2020

(54) TWO STAGE THERMAL CRACKING PROCESS WITH MULTISTAGE SEPARATION SYSTEM

(71) Applicant: Indian Oil Corporation Limited, Mumbai (IN)

(72) Inventors: Satyen Kumar Das, Faridabad (IN); Terapalli Hari Venkata Devi Prasad, Faridabad (IN); Ponoly Ramachandran Pradeep, Faridabad (IN); Arjun Kumar Kottakuna, Faridabad (IN); Debasis Bhattacharyya, Faridabad (IN); Sanjiv Kumar Mazumdar, Faridabad (IN); Sankara Sri Venkata Ramakumar, Faridabad (IN)

(73) Assignee: INDIAN OIL CORPORATION LIMITED, Mumbai (IN)

( * ) Notice: Subject to any disclaimer, the term of this patent is extended or adjusted under 35 U.S.C. 154(b) by 0 days.

(21) Appl. No.: 16/176,679

(22) Filed: Oct. 31, 2018

(65) Prior Publication Data

US 2019/0185765 A1 Jun. 20, 2019

(30) Foreign Application Priority Data

Dec. 19, 2017 (IN) ..... 201721045561

(51) Int. Cl.

| | |
|---|---|
| ***C10G 51/02*** | (2006.01) |
| ***C10G 55/04*** | (2006.01) |
| ***C10G 9/00*** | (2006.01) |
| ***C10G 7/06*** | (2006.01) |
| ***C10G 9/14*** | (2006.01) |
| ***C10G 45/00*** | (2006.01) |

(Continued)

(52) U.S. Cl.

CPC ..... *C10G 51/023* (2013.01); *C10G 7/06* (2013.01); *C10G 9/005* (2013.01); *C10G 9/14* (2013.01); *C10G 11/18* (2013.01); *C10G 45/00* (2013.01); *C10G 47/00* (2013.01); *C10G 55/04* (2013.01); *C10G 69/06* (2013.01); *C10G 2300/107* (2013.01); *C10G 2300/1044* (2013.01); *C10G 2300/1077* (2013.01); *C10G 2300/708* (2013.01); *C10G 2400/06* (2013.01)

(58) Field of Classification Search

None

See application file for complete search history.

(56) References Cited

U.S. PATENT DOCUMENTS

| | | | |
|---|---|---|---|
| 2,271,097 | A | 1/1942 | Ruthruff et al. |
| 4,378,288 | A | 3/1983 | Shih et al. |

(Continued)

OTHER PUBLICATIONS

U.S. Energy Information Administration, Definitions, Sources, and Explanatory Notes, https://www.eia.gov/dnav/pet/TblDefs/pet_pnp_capchg_tbldef2.asp, retrieved Dec. 16, 2019 (Year: 2019).*

*Primary Examiner* — Derek N Mueller

(74) *Attorney, Agent, or Firm* — Workman Nydegger

(57) ABSTRACT

The present invention relates to Delayed Coking of heavy petroleum residue producing petroleum coke and lighter hydrocarbon products. The invented process utilizes a pre-cracking reactor for mild thermal cracking of the feedstock and intermediate multistage separation system before being subjected to higher severity thermal cracking in delayed coking process, resulting in reduction in overall coke yield.

19 Claims, 8 Drawing Sheets

Schematic of process of present invention

(51) Int. Cl.

| | |
|---|---|
| ***C10G 69/06*** | (2006.01) |
| ***C10G 47/00*** | (2006.01) |
| ***C10G 11/18*** | (2006.01) |

(56) References Cited

U.S. PATENT DOCUMENTS

| | | | | |
|---|---|---|---|---|
| 4,394,250 | A | 7/1983 | Grossberg | |
| 4,604,186 | A | 8/1986 | Lutz et al. | |
| 6,048,448 | A * | 4/2000 | Nirell | C10G 9/005 208/131 |
| 8,361,310 | B2 | 1/2013 | Etter et al. | |
| 2009/0209799 | A1 | 8/2009 | Etter et al. | |
| 2011/0005968 | A1 | 1/2011 | Chakka et al. | |
| 2014/0027344 | A1 | 1/2014 | Harris et al. | |

* cited by examiner

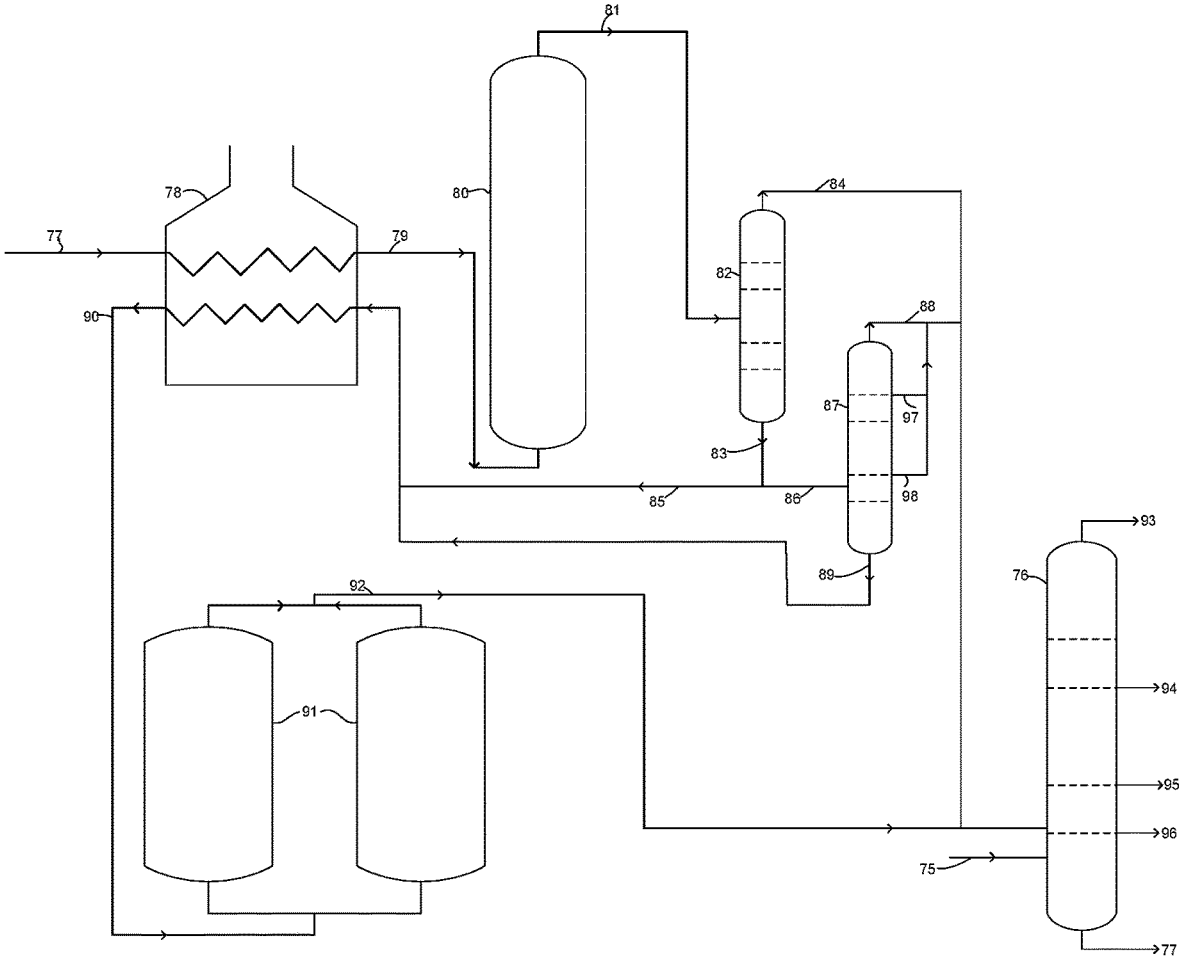
Fig. 1: Schematic of process of present invention

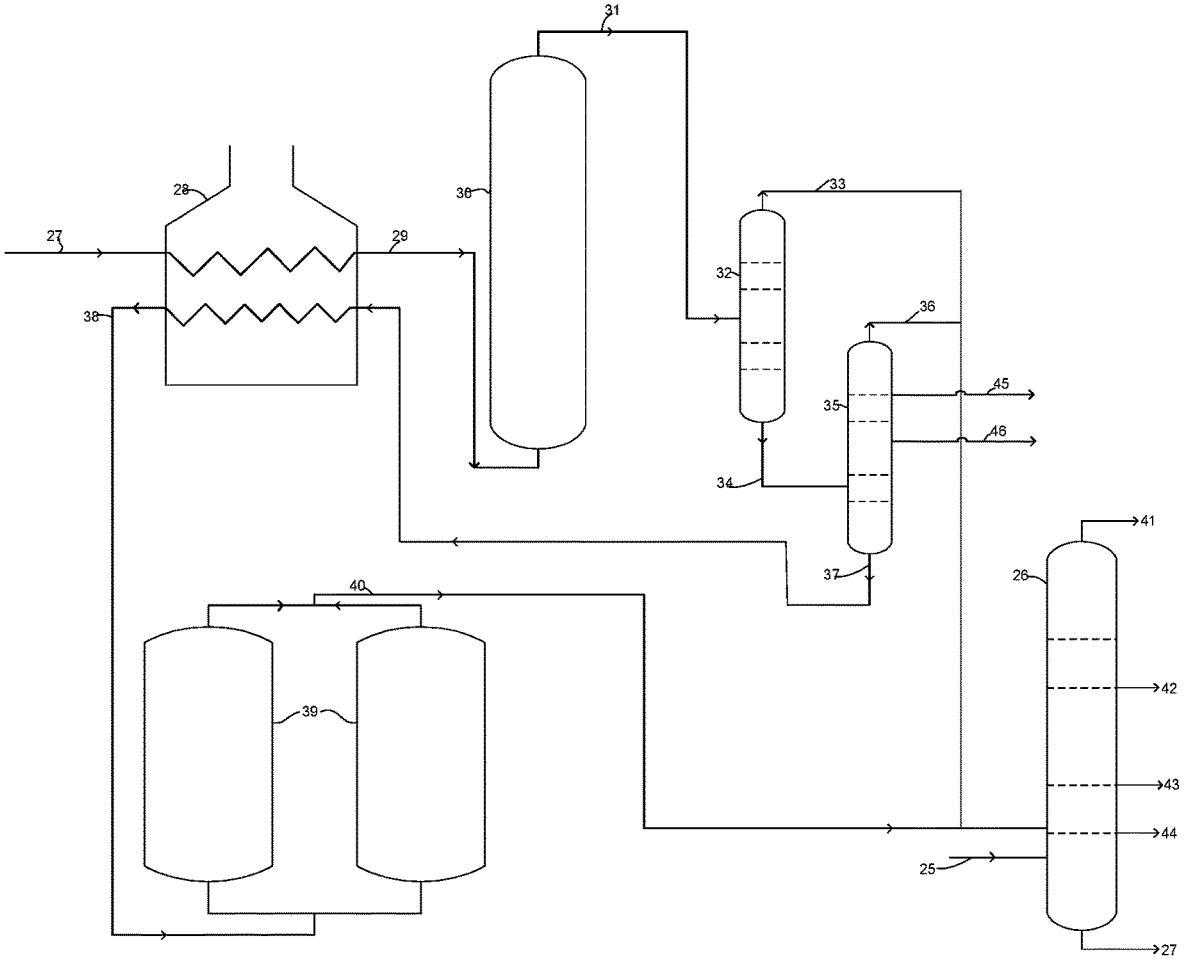
Fig. 2: Schematic of process of present invention

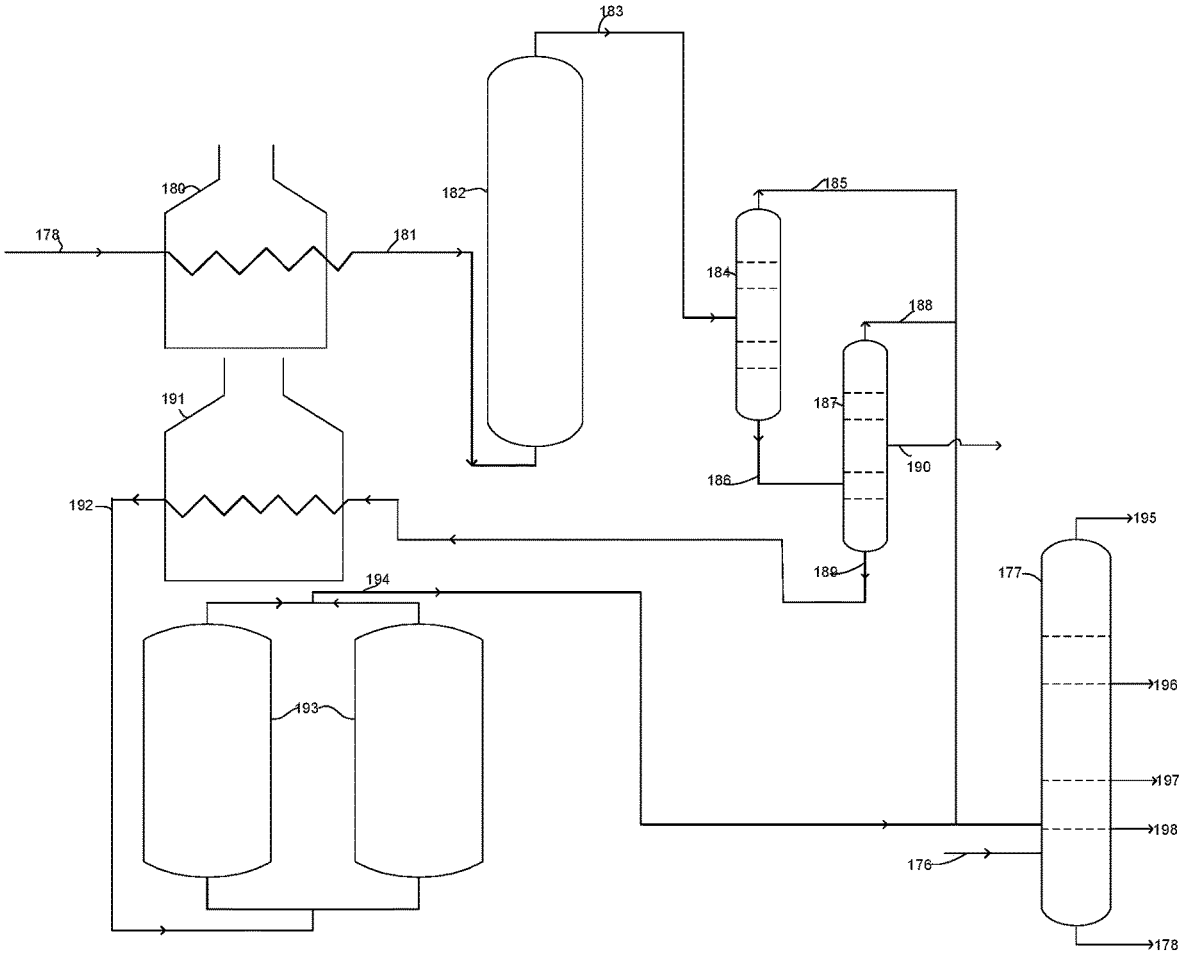
Fig. 3: Schematic of process of present invention

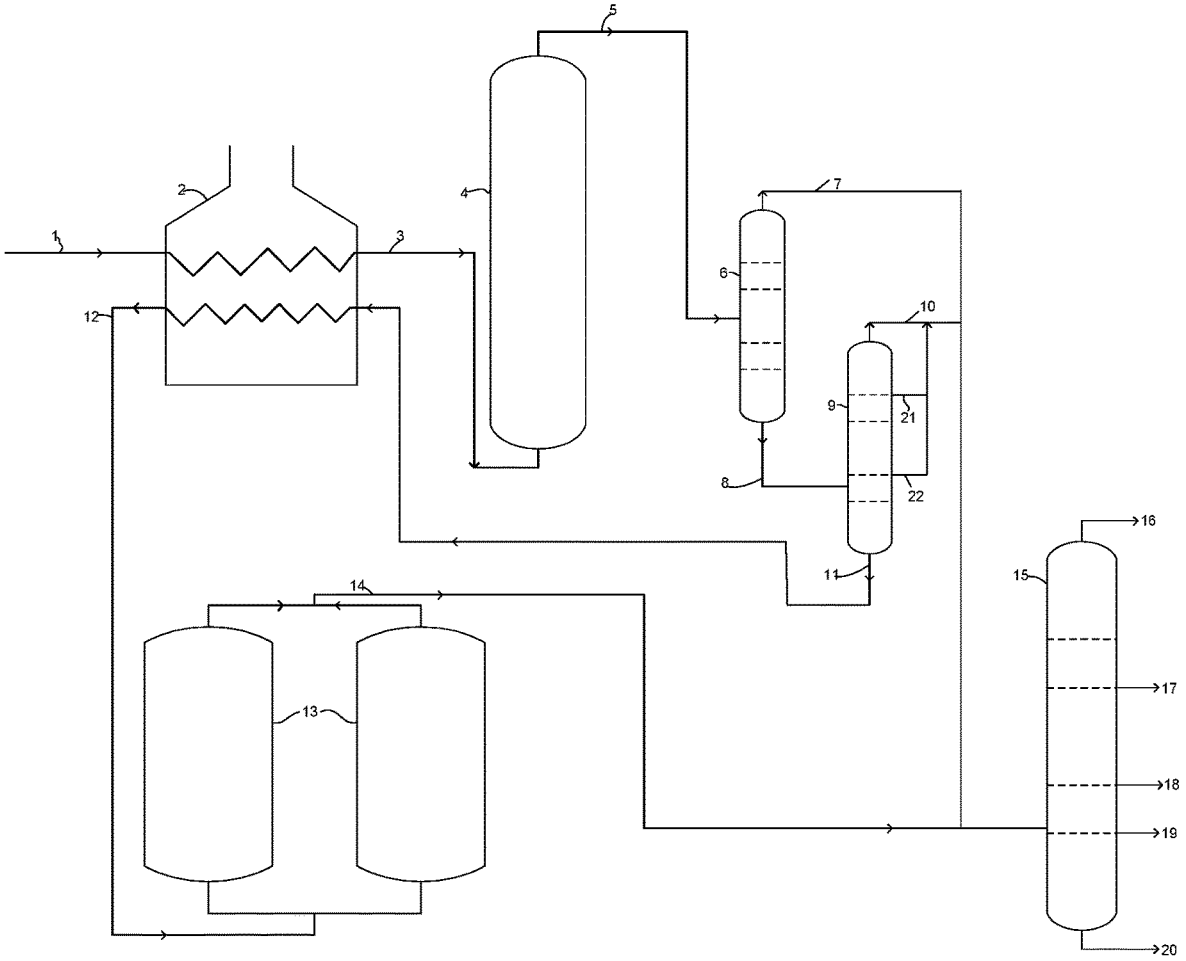
Fig. 4: Schematic of process of present invention

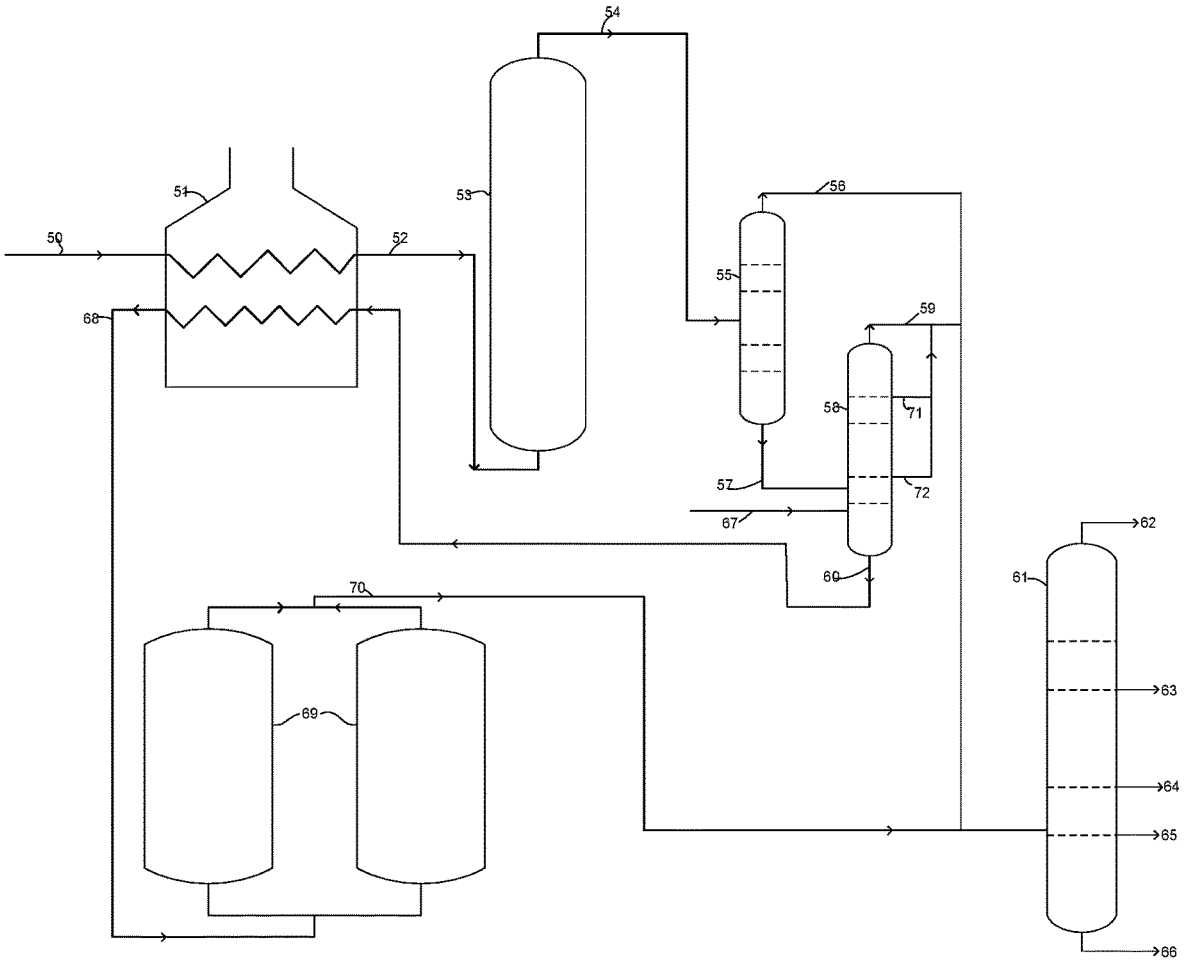
Fig. 5: Schematic of process of present invention

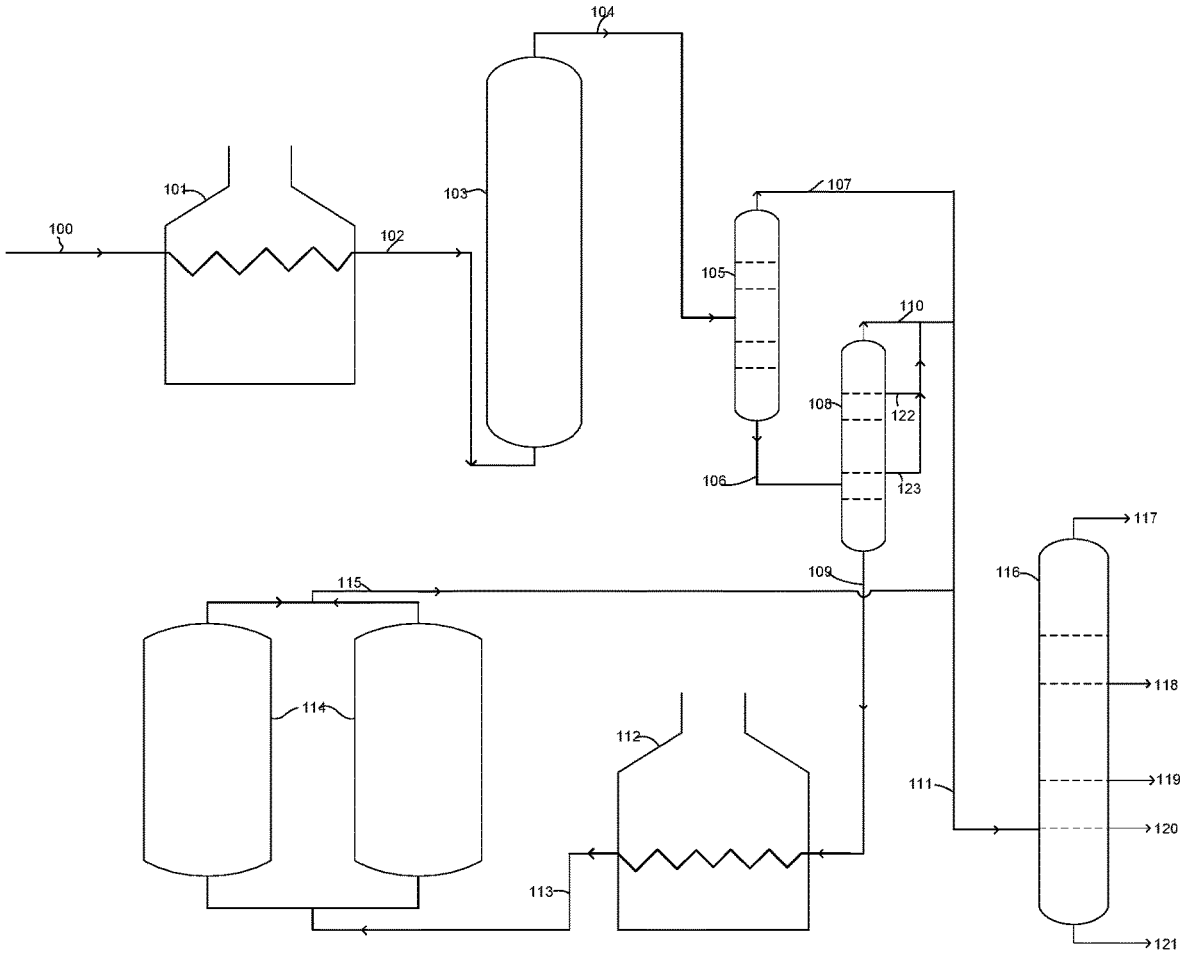
Fig. 6: Schematic of process of present invention

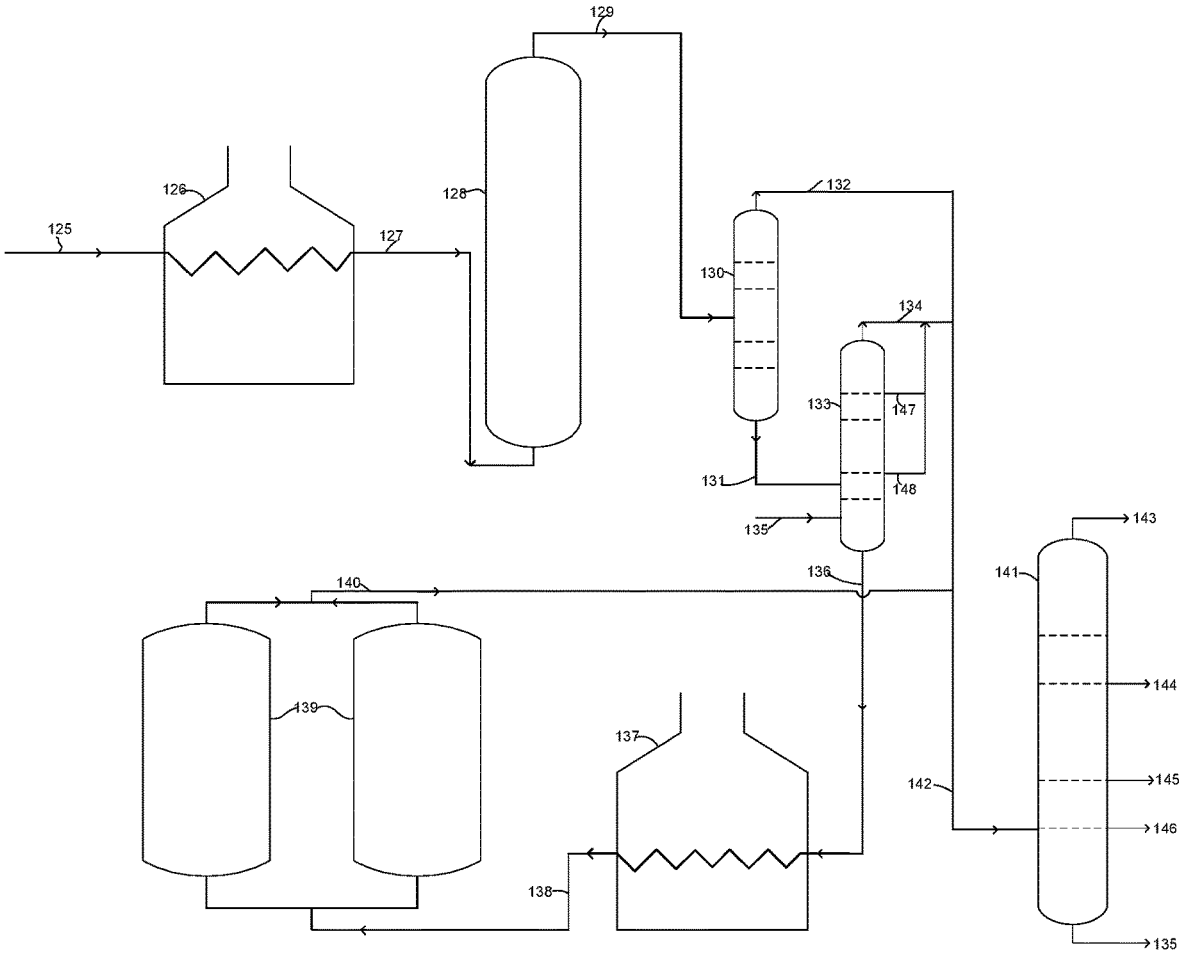
Fig. 7: Schematic of process of present invention

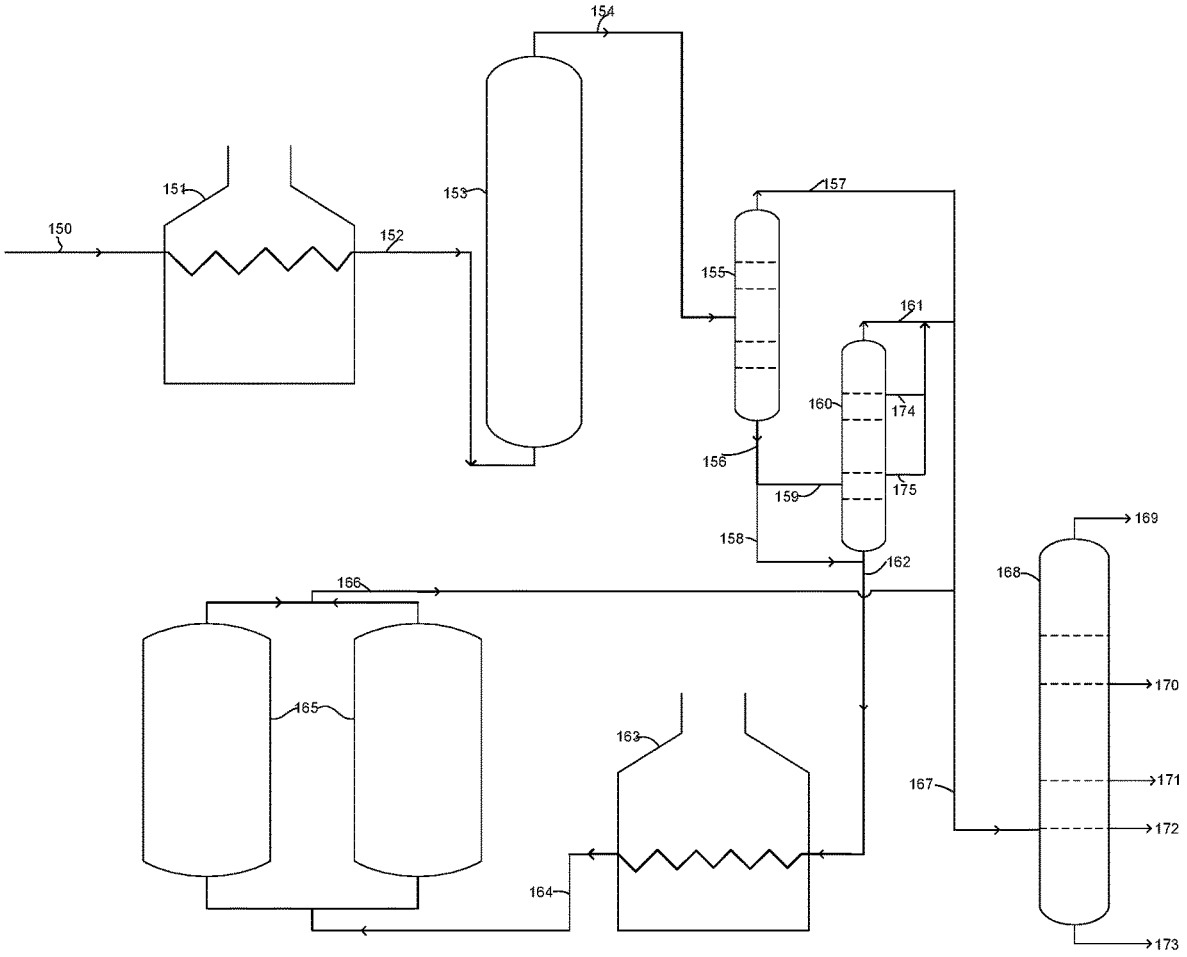
Fig. 8: Schematic of process of present invention

TWO STAGE THERMAL CRACKING PROCESS WITH MULTISTAGE SEPARATION SYSTEM

FIELD OF THE INVENTION

This invention relates to Delayed Coking process for converting petroleum residue into gaseous and liquid product streams and leaving behind solid, carbonaceous petroleum coke. The invention, in particular relates to the use of a mild thermal pre-cracking reactor and intermediate multistage separation system before the severe thermal cracking reaction zone.

BACKGROUND OF THE INVENTION

In the Delayed Coking process used in the petroleum refineries there are three varieties of cokes that are generated namely, Fuel grade coke, Anode grade coke, and Needle coke. The fuel grade coke is used as fuel in furnaces etc., and has the lowest cost per unit weight. The other two grades of coke, i.e. anode grade coke and needle coke fetch higher value than the fuel grade coke. The needle coke is the highest value product amongst the two and refiners may look into production of the needle coke as an opportunity for revenue generation. Therefore, it is highly desirable to have a process which can effectively reduce the generation of coke from delayed coking process to improve the margin around the delayed coker.

Delayed cokers are furnace-type coking units wherein the feed is rapidly heated to temperatures above coking temperature inside a furnace and the effluent from the furnace discharges (before decomposition) into a large "coke drum", where it remains until it either cracks or thermally decomposes and passes off as vapor and also condenses into coke. The excess volume of low value petroleum coke generated in a Delayed Coking unit poses the refiners with the perennial problem of coke handling, storage, removal and marketing. The principal charging stocks for general coking operations are high boiling virgin or cracked petroleum residues which may or may not be suitable as heavy fuel oils. The feed through-put to the Delayed Coking unit is controlled or reduced by diverting the feed from one coke drum to another empty drum and thereby manipulating the bed height of the coke generated inside coking drum. Therefore, it is desirable to have a process or material means to reduce the height of coke bed generated inside the coke drum, which will in turn enable higher amounts of feed to be processed inside the coke drum and reduce.

The reduction of coke yield in Delayed Coking process by manipulating the process parameters like employing low recycle ratio, low coke drum pressure during operation, etc. is known in the art. Also, various additives have been tried in the past for reducing the yield of coke and improving the lighter product yields in delayed coking process.

U.S. Pat. No. 4,378,288 have disclosed the use of free radical inhibitors like benzaldehyde, nitrobenzene, aldol, sodium nitrate etc. with a dosage of 0.005-10.0 wt % of the feedstock which majorly have been Vacuum tower bottom, Reduced crude, Thermal tar or a blend thereof. Additives used included only liquid phase additives.

Chevron Research Company in their U.S. Pat. No. 4,394,250 have disclosed use of additives such as cracking catalysts like Silica, alumina, bauxite, silica-alumina, zeolites, acid treated natural clays, Hydrocracking catalysts such as metal oxides or sulfides of groups VI, VII or VIII and Spent catalyst from FCC in presence of Hydrogen at a dosage of 0.1-3 wt % of the feedstock Hydrogen flow 50-500 SCF per $Kg/cm^2$ (g) where the additive is contacted with the feedstock before its entry into the coke drum. Hydrocarbon feedstock used in Delayed Coking have been shale oil, coal tar, reduced crude, residuum from thermal or catalytic cracking processes, hydrotreated feedstocks, etc.

Similarly, US patent publication No. 2009/0209799 discloses FCC catalysts, zeolites, alumina, silica, activated carbon, crushed coke, calcium compounds, Iron compounds, FCC Ecat, FCC spent cat, seeding agents, hydrocracker catalysts with a dosage of <15 wt % of the feed which is majorly a suitable Hydrocarbon feedstock used in Delayed Coking of boiling point higher than 565° C. to obtain a reduction in coke yield of about 5 wt %. A number of liquid and solid phase additives have been described for achieving objectives like reduction of coke yield on hydrocarbons feedstocks, suitable for processing in Delayed Coker unit, subjected to Standard Delayed Coker operating conditions in the known art. Range of the temperature studied is about 400-650° C. Reaction pressure considered 1 atm to 14 atm. Various methods for contacting hydrocarbon feedstock and additives like mixing with feed, injecting from coke drum top etc. have also been described. In some recent patents (US 2009/0209799), injection of additives into coker drum has been claimed as superior as compared to mixing with feed.

U.S. Pat. No. 4,604,186 describes the use of a visbreaker delayed coker unit combination to control the coke production. The VBU feed is diluted by providing a gas oil stream of higher hydrogen content before being subjected to visbreaking in a soaker drum. Soaker drum effluents are separated into heavy and light fractions, with the heavy fraction being routed to the Delayed coker unit along with the recycle fraction from main fractionator for further processing. It is claimed that by controlling the rate of hydrogen rich stream (gas oil) to the VBU feedstock, the overall coke yield in delayed coker unit can be controlled. Major disadvantage of this invention is the use of two separate furnaces for heating the feedstock and reaction products from soaker drum. Also, by recycling the gasoil fraction from coker unit to visbreaker unit, the total load of furnace increases resulting in higher fuel requirement.

Similarly, US patent application 2014/0027344A1 describes that the fresh feed, after mixing with a colloidal cracking catalyst is sent to the Hydrocracking section where reactions happen in the presence of hydrogen to obtain heavier product. The heavier product is then sent to a Delayed Coker section.

U.S. Pat. No. 8,361,310 B2 depicts injection of an additive package comprising catalysts, seeding agents, excess reactants, quenching agents and carrier fluids into the top of the coke drum, for various utilities like coke yield reduction.

U.S. Ser. No. 12/498,497 discloses anionic clay mixed with the hydrocarbon feedstock for reducing the coke yield Most of the patents have disclosed the use catalysts in liquid and solid phase, broadly falling in the categories of free radical inhibitors, free radical removers, free radical accelerators, stabilizers and cracking catalysts. Reported additive injection was in the range of 0.005 to 15 wt % of the feed U.S. Pat. No. 2,271,097 describes mixing of fresh feed with bottom product of fractionator and further feeding the same to the 'viscosity breaker furnace'. The product obtained is then separated in an evaporator & fractionator in series. Thermal cracking of lighter distillates adopted result in lesser yields of LPG, light olefins, and gasoline.

It is evident from the prior arts that additives or a combination of additives or catalysts are used to alter the reaction mechanism and achieve the yield improvement. However, the use additives and catalysts involve additional cost of usage. It is also possible that the metallic additives get trapped in the solid carbonaceous coke, increase the ash content rendering the product un-usable. Therefore, it is desirable to have a process capable to improve the yield pattern from the thermal cracking process, without the use of any forms of external additives.

It is desired that there should be a process which enables the refiner to reduce the coke yield more than that is achievable in the prior art. Therefore, a novel two stage thermal cracking process with multistage separation system is invented, wherein the operation in at least one separator is carried out under vacuum conditions. The Operation under vacuum conditions cause increase in relative volatility of the molecules, enabling separation of further heavier molecules which could not have been separated while using a single intermediate separator, as employed in the prior art. Further the molecules separated out in a multistage separator system will not be sent to the second thermal cracking reactor section, thereby not participating in coke formation reactions and thus decreasing the overall coke yield.

SUMMARY OF THE INVENTION

It is an objective of the present invention is the process of Delayed Coking, a process used in petroleum refineries to crack petroleum residue, thus converting it into gaseous and liquid product streams and leaving behind solid, carbonaceous petroleum coke.

According to one embodiment of the present invention, a method of reducing overall coke yield in delayed coking process, said method comprising the steps of:

a) passing fresh hydrocarbon feed to bottom of a main fractionator and mixing with internal recycle to make secondary hydrocarbon feedstock;
b) heating the secondary hydrocarbon feedstock in a furnace to obtain hot feed at a desired inlet temperature of a pre-cracking reactor;
c) passing the hot feed at desired temperature and pressure to the pre-cracking reactor, wherein the hot feed undergoes mild thermal cracking reactions to obtain outlet product material stream;
d) introducing the outlet product material stream to a first intermediate separator to split hydrocarbons in the outlet material stream into top and bottom fractions, wherein the top fraction comprises of lighter products and gases and the bottom fraction is split into first portion and second portion;
e) routing the top fraction to the main fractionator;
f) separating first portion of the bottom fraction in a second separator column operating in vacuum conditions to obtain top product and heavier product;
g) passing the top product obtained in step (f) to the main fractionator;
h) withdrawing the heavier product cuts from the second separator of step (f) and passing to the main fractionator, wherein the heavier cuts comprises of Light Vacuum Gas Oil (LVGO) and Heavy Vacuum Gas Oil (HVGO);
i) mixing the second portion from the first intermediate separator of step (d) and the bottom product from the second separator column of step (f) and heating in a furnace to a desired coking temperature to obtain hot hydrocarbon stream;
j) passing the hot hydrocarbon stream from the furnace to a preheated coke drum; and
k) passing the product vapors exiting the coke drum to the main fractionator column to obtain product fractions.

According to another embodiment of the present invention, a method of reducing overall coke yield in delayed coking process, said method comprising the steps of:

a) heating hydrocarbon feedstock in a furnace to obtain hot feed at a desired inlet temperature of a pre-cracking reactor;
b) passing the hot feed at desired temperature and pressure to the pre-cracking reactor, wherein the hot feed undergoes mild thermal cracking reactions to obtain outlet product material stream;
c) introducing the outlet product material stream to a first intermediate separator to split hydrocarbons in the outlet material stream into top and bottom fractions, wherein the top fraction comprises of lighter products and gases and the bottom fraction is split into first portion and second portion;
d) routing the top fraction to a main fractionator;
e) separating first portion of the bottom fraction in a second separator column operating in vacuum conditions to obtain top product and heavier product;
f) passing the top product obtained in step (e) to the main fractionator;
g) withdrawing the heavier product cuts from the second separator of step (e) and passing to the main fractionator to obtain heavy bottom material, wherein the heavier cuts comprises of Light Vacuum Gas Oil (LVGO) and Heavy Vacuum Gas Oil (HVGO);
h) heating the heavy bottom material in a furnace to the desired coking temperature to obtain the hot hydrocarbon stream.
i) passing the hot hydrocarbon stream from the furnace to a preheated coke drum; and
j) passing the product vapors exiting the coke drum to the main fractionator column to obtain product fractions.

Further, the present invention provides a process, which enables overall coke reduction in the order of 7 wt %, resulting in substantial margin improvement for refinery.

Various objects, features, aspects, and advantages of the present invention will become more apparent from the following drawings and detailed description of preferred embodiments of the invention.

BRIEF DESCRIPTION OF THE DRAWINGS

FIG. 1: Represents schematic flow diagram of First Scheme

FIG. 2: Represents schematic flow diagram of Second Scheme

FIG. 3: Represents schematic flow diagram of Third Scheme

FIG. 4: Represents schematic flow diagram of Fourth Scheme

FIG. 5: Represents schematic flow diagram of Fifth Scheme

FIG. 6: Represents schematic flow diagram of Sixth Scheme

FIG. 7: Represents schematic flow diagram of Seventh Scheme

FIG. 8: Represents schematic flow diagram of Eighth Scheme

DESCRIPTION OF THE INVENTION

While the invention is susceptible to various modifications and/or alternative processes and/or compositions, specific embodiment thereof has been shown by way of example in tables and will be described in detail below. It should be understood, however that it is not intended to limit the invention to the particular processes and/or compositions disclosed, but on the contrary, the invention is to cover all modifications, equivalents, and alternative falling within the spirit and the scope of the invention as defined by the appended claims.

The tables and protocols have been represented where appropriate by conventional representations, showing only those specific details that are pertinent to understanding the embodiments of the present invention so as not to obscure the disclosure with details that will be readily apparent to those of ordinary skill in the art having benefit of the description herein.

The following description is of exemplary embodiments only and is NOT intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention.

Any particular and all details set forth herein are used in the context of some embodiments and therefore should NOT be necessarily taken as limiting factors to the attached claims. The attached claims and their legal equivalents can be realized in the context of embodiments other than the ones used as illustrative examples in the description below.

The present invention relates to a method of reducing overall coke yield in a delayed coking process, wherein the process employs multistage intermediate separator system with the second stage operating in vacuum conditions to prevent the coke formation.

According to one embodiment of the present invention, a method of reducing overall coke yield in delayed coking process, said method comprising the steps of:

a) passing fresh hydrocarbon feed to the bottom of a main fractionator and mixing with internal recycle to make secondary hydrocarbon feedstock;
b) heating secondary hydrocarbon feedstock in a furnace to obtain hot feed at a desired inlet temperature of a pre-cracking reactor;
c) passing the hot feed at desired temperature and pressure to the pre-cracking reactor, wherein the hot feed undergoes mild thermal cracking reactions to obtain outlet product material stream;
d) introducing the outlet product material stream to a first intermediate separator to split hydrocarbons in the outlet material stream into top and bottom fractions, wherein the top fraction comprises of lighter products and gases and the bottom fraction is split into first portion and second portion;
e) routing the top fraction to the main fractionator;
f) separating first portion of the bottom fraction in a second separator column operating in vacuum conditions to obtain top product, heavier product, and bottom product;
g) passing the top product obtained in step (f) to the main fractionator;
h) withdrawing the heavier product cuts from the second separator column of step (f) and passing to the main fractionator, wherein the heavier cuts comprises of Light Vacuum Gas Oil (LVGO) and Heavy Vacuum Gas Oil (HVGO);
i) mixing the second portion from the first intermediate separator of step (d) and the bottom product from the second separator column of step (f) and heating in a furnace to a desired coking temperature to obtain hot hydrocarbon stream;
j) passing the hot hydrocarbon stream from the furnace to a preheated coke drum; and
k) passing the product vapors exiting the coke drum to the main fractionator column to obtain product fractions.

According to another embodiment of the present invention, a method of reducing overall coke yield in delayed coking process, said method comprising the steps of:

a) heating hydrocarbon feedstock in a furnace to obtain hot feed at a desired inlet temperature of a pre-cracking reactor;
b) passing the hot feed at desired temperature and pressure to the pre-cracking reactor, wherein the hot feed undergoes mild thermal cracking reactions to obtain outlet product material stream;
c) introducing the outlet product material stream to a first intermediate separator to split hydrocarbons in the outlet material stream into top and bottom fractions;
d) routing the top fraction to a main fractionator;
e) separating first portion of the bottom fraction in a second separator column operating in vacuum conditions to obtain top product, heavier product cuts, and heavy bottom material;
f) passing the top product obtained in step (e) to the main fractionator;
g) withdrawing the heavier product cuts from the second separator of step (e) and passing to the main fractionator, wherein the heavier cuts comprises of Light Vacuum Gas Oil (LVGO) and Heavy Vacuum Gas Oil (HVGO);
h) heating the heavy bottom material in a furnace to the desired coking temperature to obtain the hot hydrocarbon stream.
i) passing the hot hydrocarbon stream from the furnace to a preheated coke drum; and
j) passing the product vapors exiting the coke drum to the main fractionator column to obtain product fractions.

According to an embodiment of the present invention, in step (a) the fresh hydrocarbon feedstock is heated directly in the furnace.

According to a preferred embodiment of the present invention, the product fraction comprises of off-gas with LPG and naphtha, Kerosene, Light Coker Gas Oil (LCGO), Heavy Coker Gas Oil (HCGO), and heavy bottom product, wherein the heavy bottom product comprises of Coker Fuel Oil (CFO). According to another embodiment of the present invention, the heavy bottom product from the main fractionator may be routed to the second separator.

According to another embodiment of the present invention, vacuum gasoil range cut may be withdrawn from the second separator and passed to secondary processing units. In another embodiment of the present invention, the heavier cuts may be withdrawn from the second separator and passed to secondary processing units. The secondary processing unit comprises of fluid catalytic cracking, hydrocracker and/or hydrotreater units.

According to yet another embodiment of the present invention, the heavier product cuts may be passed to secondary processing units.

According to another embodiment of the present invention, the top product from the second separator may be routed to at least one of product treatments units and the secondary processing unit.

According to yet another embodiment of the present invention, a single stream is withdrawn from the second separator and passed to the secondary processing units.

Feedstock

Liquid hydrocarbon feedstock used in the process may be selected from heavy hydrocarbon feedstock comprising of vacuum residue, atmospheric residue, deasphalted pitch, shale oil, coal tar, clarified oil, residual oils, heavy waxy distillates, foots oil, slop oil, crude oil or blends of such hydrocarbons. The Conradson carbon residue content of the feedstock may be above 4 wt % and density can be minimum of 0.95 g/cc.

Reaction Conditions

According to an embodiment of the present invention, the pre-cracking reactor may be operated in the desired operating temperature ranging from 350 to 470° C., preferably between 420° C. to 470° C.

In another embodiment of the present invention, the desired operating pressure inside pre-cracking reactor ranging from 1 to 15 $Kg/cm^2$ (g) preferably between 5 to 12 $Kg/cm^2$ (g).

In another embodiment of the present invention, the residence time inside the pre-cracking reactor range from 1 to 40 minutes, preferably operated in the range of 5 to 30 minutes.

According to an embodiment of the present invention, the multistage intermediate separation system comprising of minimum two separator columns, wherein the first separator may be operated at a pressure ranging from 1 to 6 $Kg/cm^2$ (g), preferably in the range of 1.5 to 5 $Kg/cm^2$ (g).

In another embodiment of the present invention, the first separator may be operated at a bottom temperature of 300 to 400° C., preferably in the range of 350 to 390° C.

In another embodiment of the present invention, the second separator column can be operated at a pressure of 10 to 200 mmHg, preferably in the range of 20 to 75 mmHg.

In yet another embodiment of the present invention, the second separator may be operated at a bottom temperature of 200 to 350° C., preferably in the range of 270 to 330° C.

According to an embodiment of the present invention, the second stage coke drums may be operated at a higher severity with desired operating temperature ranging from 470 to 520° C., preferably between 480° C. to 500° C.

In another embodiment of the present invention, the desired operating pressure ranging from 0.5 to 5 $Kg/cm^2$ (g) preferably between 0.6 to 3 $Kg/cm^2$ (g).

In yet another embodiment of the present invention, the residence time provided in coke drums is more than 10 hours.

Process Description

In accordance to FIG. 1 of the present invention, Resid feedstock (75) is introduced to bottom section of main fractionator column (76) and the same gets mixed with internal recycle fraction to form secondary feed (77). The secondary feed (77) is then heated in a furnace (78) to obtain hot feed (79) at the desired inlet temperature of a pre-cracking reactor. The Hot feed at desired temperature and pressure is sent to the pre-cracking reactor (80), where it undergoes mild thermal cracking reactions to obtain outlet product stream. The outlet product material stream (81) is then sent to first intermediate separator (82) to split hydrocarbons in the outlet product stream into two fractions, namely top fraction (84) and bottom fraction (83). The top fraction (84) comprising of lighter products including gases is sent to the main fractionator (76). The bottom fraction (83) is further split into two fractions (85, 86) namely first portion (86) and second portion (85). The first portion of the bottom fraction (86) is subjected to further separation in a second separator column (87) operating at vacuum conditions to obtain top product (88) and bottom product (89).

According to an embodiment of the present invention, the term second separation column can be used interchangeably with the term second intermediate separator.

Further, removal of lighter material is achieved in the second separator column and the top product (88) is sent to the main fractionator (76). Two heavier product cuts namely, Light Vacuum Gas Oil (LVGO) (97) and Heavy Vacuum Gas Oil (HVGO) (98) are also withdrawn from the second intermediate separator and are sent to the main fractionator. The second portion of heavy bottom material (85) from the first separator and bottom product (89) from the second separator column are mixed and then subjected to heating in furnace (78) to the desired coking temperature to obtain hot hydrocarbon stream. The hot hydrocarbon stream (90) exiting the furnace is then sent to the preheated coke drum (91), where it is provided with a longer residence time for thermal cracking reactions to obtain product vapors. The product vapors exiting the coke drum (92) are routed to the main fractionator (76) column for further separation into desired product fractions comprising of off-gas with LPG and naphtha (93), Kerosene (94), Light Coker Gas Oil (LCGO) (95), and Heavy Coker Gas Oil (HCGO) (96). The entry points of products from the intermediate separator and the coke drum to the main fractionator may be suitably selected based on good engineering practices.

Another embodiment of the invention is provided in accordance to FIG. 2 of the present invention, wherein Resid feedstock (25) is sent to bottom section of main fractionator column (26) and the same gets mixed with internal recycle fraction to form secondary feed (27). The secondary feed (27) is then heated in a furnace (28) to obtain hot feed (29) at the desired inlet temperature of pre-cracking reactor. The hot feed at desired temperature and pressure is sent to the pre-cracking reactor (30), where it undergoes mild thermal cracking reactions to obtain outlet product material stream. The outlet product material stream (31) is then sent to first intermediate separator (32) to split the hydrocarbons into two fractions namely top fraction (33) and bottom fraction (34). The top fraction (33) comprising of lighter products including gases are sent to the main fractionator (26). The bottom fraction (34) is then subjected to further separation in a second separator column (35) operating at vacuum conditions. Further removal of lighter material is achieved in the second separator to obtain top product (36) and heavy bottom material (37). The top product (36) is sent to the main fractionator (26). Two heavier product cuts namely Light Vacuum Gas Oil (LVGO) (45) and Heavy Vacuum Gas Oil (HVGO) (46) are also withdrawn from the second intermediate separator and are sent to other secondary processing units comprising of fluid catalytic cracking, hydrocracker and/or hydrotreater units. The heavy bottom material (37) is then subjected to heating in a furnace (28) to the desired coking temperature to obtain hot hydrocarbon stream (38). The hot hydrocarbon stream (38) exiting the furnace is then sent to the preheated coke drum (39), where it is provided with a longer residence time for thermal cracking reactions to obtain the product vapors. The product vapors exiting the coke drum (40) are sent to the main fractionator (26) column for further separation into desired product fractions comprising of off-gas with LPG and naphtha (41), Kerosene (42), LCGO (43), and HCGO (44). The entry points of products from the second intermediate separator and the coke drum to the main fractionator may be suitably selected based on good engineering practices.

In an embodiment of the present invention, a single stream is withdrawn from the intermediate separator and sent to the other secondary processing units comprising of fluid catalytic cracking, hydrocracker and/or hydrotreater units.

Another embodiment of the invention is provided in accordance to FIG. 3 of the present invention, wherein Resid feedstock (176) is sent to bottom section of main fractionator column (177) and the same gets mixed with internal recycle fraction to form secondary feed (178). The secondary feed (178) is then heated in a furnace (180) to obtain hot feed (181) at the desired inlet temperature of pre-cracking reactor. The hot feed at desired temperature and pressure is sent to the pre-cracking reactor (182), where it undergoes mild thermal cracking reactions to obtain outlet product stream. The outlet product material stream (183) is then sent to first intermediate separator (184) to split the hydrocarbons into two fractions, namely top fraction (185) and bottom fraction (186). The top fraction (185) comprising of lighter products including gases are sent to the main fractionator (177). The bottom fraction (186) is then subjected to further separation in a second separator column (187) operating at vacuum conditions. Further removal of lighter material is achieved in the second separator to obtain top product (188) and heavy bottom material (189). The top product (188) is sent to the main fractionator (177). A vacuum gasoil range cut (190) is also withdrawn from the second intermediate separator and are sent to other secondary processing units comprising of fluid catalytic cracking, hydrocracker and/or hydrotreater units. The heavy bottom material (189) is then subjected to heating in a second furnace (191) to the desired coking temperature to obtain hot hydrocarbon stream (192). The hot hydrocarbon stream (192) exiting the furnace is then sent to the preheated coke drum (193), where it is provided with a longer residence time for thermal cracking reactions to obtain product vapors. The product vapors exiting the coke drum (194) are sent to the main fractionator (177) column for further separation into desired product fractions comprising of offgas with LPG and naphtha (195), Kerosene (196), LCGO (197), HCGO (198). The entry points of products from intermediate separator and coke drum to the main fractionator may be suitably selected based on good engineering practices.

In an embodiment of the present invention, the top product (188) from second intermediate separator (187) is routed to other product treatment units or secondary processing units.

Another embodiment of the present invention is provided in accordance with FIG. 4 of the present invention, wherein Resid feedstock (1) is heated in a Furnace (2) to obtain hot feed (3) at desired inlet temperature of pre-cracking reactor. The hot feed at desired temperature and pressure is sent to the pre-cracking reactor (4), where it undergoes mild thermal cracking reactions to obtain outlet product material. The outlet product material stream (5) is then sent to first intermediate separator (6) to split the hydrocarbons into two fractions namely top fraction (7) and bottom fraction (8). The top fraction (7) containing lighter products comprising of gases are sent to the main fractionator (15). The bottom fraction (8) is then subjected to further separation in a second separator column (9) operating at vacuum conditions to obtain top product (10) and heavy bottom material (11). Further removal of lighter material is achieved in the second separator and the top product (10) is sent to the main fractionator (15). Two heavier product cuts namely, Light Vacuum Gas Oil (LVGO) (21) and Heavy Vacuum Gas Oil (HVGO) (22) are also withdrawn from the second intermediate separator and are sent to the fractionator. The heavy bottom material (11) is then subjected to heating in furnace (2) to the desired coking temperature to obtain hot hydrocarbon steam. The hot hydrocarbon stream (12) exiting the furnace is then sent to the preheated coke drum (13), where it is provided with a longer residence time for thermal cracking reactions to obtain product vapors. The product vapors exiting the coke drum (14) are sent to the main fractionator (15) column for further separation into desired product fractions comprising of off-gas with LPG and naphtha (16), Kerosene (17), LCGO (18), HCGO (19) and Coker Fuel Oil (CFO) (20). The entry points of products from intermediate separator and coke drum to the main fractionator may be suitably selected based on good engineering practices.

Another embodiment of the present invention is provided in accordance with FIG. 5 of the present invention, wherein Resid feedstock (50) is heated in a Furnace (51) to obtain hot feed (52) at desired inlet temperature of pre-cracking reactor. The hot feed at desired temperature and pressure is sent to the pre-cracking reactor (53), where it undergoes mild thermal cracking reactions to obtain outlet product material. The outlet product material stream (54) is then sent to first intermediate separator (55) to split the hydrocarbons into two fractions, namely top fraction (56) and bottom fraction (57). The top fraction (56) containing lighter products including gases are sent to the main fractionator (61). The bottom fraction (57) is then subjected to further separation in a second separator column (58) operating at vacuum conditions to obtain top product (59) and heavy bottom material (60). Further removal of lighter material is achieved in the second separator and the top product (59) is sent to the main fractionator (61). Two heavier product cuts Light Vacuum Gas Oil (LVGO) (71) and Heavy Vacuum Gas Oil (HVGO) (72) are also withdrawn from the second intermediate separator and are sent to the fractionator. The heavy bottom material (60) is then subjected to heating in furnace (51) to the desired coking temperature to obtain hot hydrocarbon stream. The hot hydrocarbon stream (68) exiting the furnace is then sent to the preheated coke drum (69), where it is provided with a longer residence time for thermal cracking reactions to obtain the product vapors. The product vapors exiting the coke drum (70) are sent to the main fractionator (61) column for further separation into desired product fractions comprising of off-gas with LPG and naphtha (62), Kerosene (63), Light Coker Gas Oil (LCGO) (64), Heavy Coker Gas Oil (HCGO) (65) and heavy bottom product boiling in the range of coker fuel oil (66). Further, the heavy bottom product (66) from the main fractionator column (61) is routed to the bottom of the second separator column (58). The entry points of products from intermediate separator and coke drum to the main fractionator may be suitably selected based on good engineering practices.

Another embodiment of the present invention is provided in accordance with FIG. 6 of the present invention, wherein Resid feedstock (100) is heated in a Furnace (101) to obtain the hot feed (102) at desired inlet temperature of pre-cracking reactor. The hot feed at desired temperature and pressure is sent to the pre-cracking reactor (103), where it undergoes mild thermal cracking reactions to obtain the outlet product material. The outlet product material stream (104) is then sent to first intermediate separator (105) to split the hydrocarbons into two fractions, namely top fraction (107) and bottom fraction (106). The top fraction (107) comprising of lighter products including gases are sent to the main fractionator (116). The bottom fraction (106) is then subjected to further separation in a second separator column (108) operating at vacuum conditions. Further removal of lighter material is achieved in the second separator to obtain top product (110) and heavy bottom product (109). The top product (110) is sent to the main fractionator (116). Two heavier product cuts, namely Light Vacuum Gas Oil (LVGO) (122) and Heavy Vacuum Gas Oil (HVGO) (123) are also withdrawn from the second intermediate separator and are sent to the fractionator. The heavy bottom material (109) is then subjected to heating in a second furnace (112) to the desired coking temperature to obtain hot hydrocarbon stream. The hot hydrocarbon stream (113) exiting the furnace is then sent to the preheated coke drum (114), where it is provided with a longer residence time for thermal cracking reactions to obtain product vapors. The product vapors exiting the coke drum (115) are sent to the main fractionator (116) column for further separation into desired product fractions comprising of off-gas with LPG and naphtha (117), Kerosene (118), LCGO (119), HCGO (120) and CFO (121). The entry points of products from intermediate separator and coke drum to the main fractionator may be suitably selected based on good engineering practices.

Another embodiment of the present invention is provided in accordance with FIG. 7 of the present invention, wherein Resid feedstock (125) is heated in a Furnace (126) to obtain hot feed (127) at the desired inlet temperature of pre-cracking reactor. The Hot feed at desired temperature and pressure is sent to the pre-cracking reactor (128), where it undergoes mild thermal cracking reactions to obtain outlet product stream. The outlet product material stream (129) is then sent to the first intermediate separator (130) to split the hydrocarbons into two fractions, namely top fraction (132) and bottom fraction (131). The top fraction (132) containing lighter products including gases are sent to the main fractionator (141). The bottom fraction (131) is then subjected to further separation in a second separator column (133) operating in vacuum conditions to obtain top product (134) and heavy bottom material (136). Further removal of lighter material is achieved in the second separator and the top product (134) is sent to the main fractionator (141). Two heavier product cuts, namely Light Vacuum Gas Oil (LVGO) (147) and Heavy Vacuum Gas Oil (HVGO) (148) are also withdrawn from the second intermediate separator and are sent to the fractionator. The heavy bottom material (136) is then subjected to heating in a second furnace (137) to the desired coking temperature. The hot hydrocarbon stream (138) exiting the furnace is then sent to the preheated coke drum (139), where it is provided with a longer residence time for thermal cracking reactions to obtain product vapors. The product vapors exiting the coke drum (140) mixes with other vapor products to form a combined vapor (142) and is sent to the main fractionator (141) column for further separation into desired product fractions comprising of off-gas with LPG and naphtha (143), Kerosene (144), LCGO (145), HCGO (146) and heavy bottom product boiling in the range of coker fuel oil (135). The heavy bottom product (135) from the main fractionator column (141) is also routed to the bottom of the second separator column (133). The entry points of products from intermediate separator and coke drum to the main fractionator may be suitably selected based on good engineering practices.

Another embodiment of the present invention is provided in accordance with FIG. 8 of the present invention, wherein Resid feedstock (150) is heated in a furnace (151) to obtain hot feed (152) at desired inlet temperature of pre-cracking reactor. The hot feed at the desired temperature and pressure is sent to the pre-cracking reactor (153), where it undergoes mild thermal cracking reactions. The outlet product material stream (154) is then sent to the first intermediate separator (155) to split the hydrocarbons into two fractions, namely top fraction (157) and bottom fraction (156). The top fraction (157) comprising of lighter products including gases are sent to the main fractionator (168). The bottom fraction (156) is then split into two fractions (158, 159), namely first portion (159) and second portion (158). First portion of the bottom product (159) subjected to further separation in a second separator column (160) operating in vacuum conditions to obtain top product (161) and bottom product (162). Further removal of lighter material is achieved in the second separator and the top product (161) is sent to the main fractionator (168). Two heavier product cuts namely Light Vacuum Gas Oil (LVGO) (174) and Heavy Vacuum Gas Oil (HVGO) (175) are also withdrawn from the second intermediate separator and are sent to the fractionator. The second portion of heavy bottom material (158) from first separator and bottom product (162) from second separator column are mixed and is then subjected to heating in a second furnace (163) to the desired coking temperature to obtain hot hydrocarbon stream. The hot hydrocarbon stream (164) exiting the furnace is then sent to the preheated coke drum (165), where it is provided with a longer residence time for thermal cracking reactions to obtain product vapors. The product vapors exiting the coke drum (166) are sent to the main fractionator (168) column for further separation into desired product fractions comprising of off-gas with LPG and naphtha (169), Kerosene (170), LCGO (171), HCGO (172), and CFO (173). The entry points of products from intermediate separator and coke drum to the main fractionator may be suitably selected based on good engineering practices.

In an embodiment of the present invention, Light Vacuum Gas Oil (LVGO) and Heavy Vacuum Gas Oil (HVGO) are also withdrawn from the second intermediate separator and are sent to other secondary processing units comprising of fluid catalytic cracking, hydrocracker and/or hydrotreater units.

According to an embodiment of the present invention, incorporation of 'Pre-cracker reactor' in the first thermal cracking section is an advantage of the present invention, as this enables control of thermal cracking reaction rate by means of reaction time control. The process of the present invention, avoids the use of hydrogen, catalysts, and/or additives and thus enables the process to be cost effective. The present invention employs multistage separation system, in which the second separator works in vacuum conditions. Operation under vacuum conditions cause increase in relative volatility of the molecules, enabling separation of further heavier molecules. Since these molecules are separated out in the multistage separator system, they are not sent to the second thermal cracking reactor section, thereby the molecules do not participate in further coke formation reactions. This effectively reduces coke to a further extend.

EXAMPLES

Pilot scale experimental study is carried out for validating the merits of the invented process schemes. Experiments are carried out with a resid feedstock of characteristics provided in Table-1.

TABLE 1

| Properties of resid feedstock | Value |
|---|---|
| Feed characteristics | |
| Density, g/cc | 1.042 |
| CCR, wt % | 23.39 |
| Asphaltene content, wt % | 7.8 |
| Sulfur, wt % | 5.73 |
| Liquid analysis (D2887/D6352) wt % | ° C. |
| 0 | 409 |
| 10 | 506 |
| 30 | 562 |
| 50 | 600 |
| 70 | 639 |
| 80 | 659 |
| 90 | 684 |
| 95 | 698 |
| Metal, ppm | |
| Fe | 6 |
| Ca | 3 |
| Cr | 1 |
| Si | 1 |

A base case experiment is carried out in the delayed coker pilot plant using the resid feedstock at delayed coking conditions. The operating conditions for all the experiments are 495° C., feed furnace outlet line temperature, 1.05 Kg/cm2 (g) coke drum pressure, 1 wt % steam addition to the coker feed and a feed rate maintained at about 8 kg/h. The operation is carried out in semi batch mode. The vapors from the coking drums are recovered as liquid and gas products and no coker product is recycled to the coker drum. Major operating parameters and the corresponding discrete product yield pattern are provided in Table-2.

TABLE 2

Base case pilot plant experimental data with resid feedstock at delayed coker conditions.

| | Unit | Value |
|---|---|---|
| Feed characteristics | | |
| Feed rate | Kg/hr | 8 |
| Run duration | Hr | 12 |
| Coil Outlet Temperature | ° C. | 495 |
| Drum pressure | kg/cm$^2$ | 1.05 |
| Yield (Basis: fresh feed) | | |
| Fuel gas | wt % | 6.82 |
| LPG | wt % | 5.66 |
| $C_5$-140° C. | wt % | 9.38 |
| 140-370° C. | wt % | 26.80 |
| 370° C.+ | wt % | 24.40 |
| Coke | wt % | 26.94 |

The yields obtained from the base case experiment as provided in Table-2 form the conventional Delayed coker unit (DCU) process yields for the resid feedstock taken.

In order to find the yields from invented process, a first experiment is carried out with the resid feedstock of Table-1 at mild thermal cracking conditions envisaged for the pre-cracker reactor. Total products from the pre-cracker reactor are sent to the single intermediate separator, where heavy bottom material (370° C.+) is separated in the bottom and this material is subjected to coking, in the delayed coker section.

After the first experiment, a second experiment was conducted with the resid feedstock of Table-1 at mild thermal cracking conditions envisaged for the pre-cracker reactor. In this second experiment, 2 nos. of intermediate separators were employed. Total products from the pre-cracker reactor are sent to the single intermediate separator, where heavy bottom material (370° C.+) is separated in the bottom and this material is routed to the second intermediate separator operating in vacuum conditions for further separation. The heavy product material separated in the bottom (540° C.+) and this material is subjected to coking, in the delayed coker section.

The major operating parameters for these experiments are provided in Table-3.

TABLE 3

Pilot plant experimental conditions maintained for the scheme of current invention is compared with that of the scheme with single intermediate separator.

| Process conditions | Unit | Experiment 1 | Experiment 2 |
|---|---|---|---|
| Run duration | hrs | 12 | 12 |
| Feed rate | Kg/hr | 8 | 8 |
| Pre-cracker inlet temp | ° C. | 440 | 440 |
| Pre-cracker outlet temp | ° C. | 411 | 411 |
| Pre-cracker inlet pressure | Kg/cm$^2$(g) | 12.3 | 12.3 |
| Pre-cracker outlet pressure | Kg/cm$^2$(g) | 11.9 | 11.9 |
| First Intermediate separator top pressure | Kg/cm$^2$(g) | 4 | 1 |
| Second Intermediate separator top pressure | mmHg | — | 50 |
| Coil Outlet Temperature (for heavy bottom material from intermediate separator) | ° C. | 495 | 495 |
| Drum pressure | Kg/cm$^2$(g) | 1.05 | 1.05 |

From the experimental data the yields for the invented process scheme is estimated and is compared with the base case delayed coker yields, in Table-4.

TABLE 4

Comparison of yields obtained in invented process and the base case DCU yields

| Yields | Base case DCU yields Wt % | Experiment-1 Wt % | Yield improvement ΔWt % | Experiment-2 Wt % | Yield improvement ΔWt % |
|---|---|---|---|---|---|
| Fuel gas | 6.82 | 6.92 | +0.10 | 6.23 | −0.59 |
| LPG | 5.66 | 5.81 | +0.15 | 5.23 | −0.43 |
| $C_5$-140° C. | 9.38 | 9.40 | +0.02 | 8.46 | −0.92 |
| 140-370° C. | 26.80 | 34.60 | +7.80 | 31.14 | +4.34 |
| 370° C.+ | 24.40 | 21.82 | −2.58 | 29.06 | +4.66 |
| Coke | 26.94 | 21.45 | −5.49 | 19.88 | −7.06 |

The experimental data reported in Table-4 shows that while there is an improvement in diesel range products (140-370° C. and 370° C.+) of about 5.22 wt %, use of an additional intermediate separator operating in vacuum conditions improves yields of these products by 9 wt %. Also, the coke yield is further improved in the second experiment with additional intermediate separator to 7.06 wt % compared to the conventional delayed coking process.

The products after being separated in the first intermediate separator used in the present invention comprises of hydrocarbon mixture boiling ranges in the close range. In the second intermediate separator, the pressure is employed below atmospheric/vacuum condition which facilitates increase in relative volatility between the constituent hydrocarbons. Also, the material separated in the second intermediate separator top is in the boiling range of 370-540° C., which may form a part of the Heavy Coker Gasoil stream withdrawn from the common fractionator and is usually routed to Hydrocracker unit, the major product of which is diesel. From the data given in the tables above, it can be seen that in the present invention, the major objectives are to maximize the 370-540° C. yields and reduce coke yields from the residue feedstock, so that the overall diesel production can be maximized.

Those of ordinary skill in the art will appreciate upon reading this specification, including the examples contained herein, that modifications and alterations to the composition and methodology for making the composition may be made within the scope of the invention and it is intended that the scope of the invention disclosed herein be limited only by the broadest interpretation of the appended claims to which the inventor is legally entitled.

The invention claimed is:

1. A method of reducing overall coke yield in a delayed coking process, said method comprising the steps of:

a) passing a fresh hydrocarbon feed to a bottom of a main fractionator and mixing with internal recycle to make a secondary hydrocarbon feedstock;

b) heating the secondary hydrocarbon feedstock in a furnace to obtain hot feed at a desired inlet temperature of a pre-cracking reactor;

c) passing the hot feed at the desired inlet temperature and a pressure to the pre-cracking reactor, wherein the hot feed undergoes mild thermal cracking reactions to obtain an outlet product material stream;

d) introducing the outlet product material stream to a first intermediate separator to split hydrocarbons in the outlet material stream into a first top product and bottom fractions, wherein the first top product comprises lighter products and gases and the bottom fractions is split into a first portion and a second portion;

e) routing the first top product to the main fractionator;

f) separating a first portion of the bottom fractions in a second intermediate separator column operating at vacuum conditions to obtain a second top product and a heavier bottom product;

g) passing the second top product obtained in step (f) to the main fractionator;

h) withdrawing the heavier bottom product from the second intermediate separator column of step (f) and passing to the main fractionator, wherein the heavier bottom product comprises Light Vacuum Gas Oil (LVGO) and Heavy Vacuum Gas Oil (HVGO);

i) mixing the second portion from the first intermediate separator of step (d) and the heavier bottom product from the second intermediate separator column of step (f) and heating in a furnace to a desired coking temperature to obtain a hot hydrocarbon stream;

j) passing the hot hydrocarbon stream from the furnace to a preheated coke drum; and k) passing product vapors exiting the coke drum to the main fractionator column to obtain product fractions.

2. The method as claimed in claim 1, wherein in step (a) the fresh hydrocarbon feedstock is heated directly in the furnace.

3. The method as claimed in claim 1, wherein a vacuum gasoil range cut is withdrawn from the second intermediate separator column and passed to secondary processing units, wherein the secondary processing units are selected from fluid catalytic cracking, hydrocracker and/or hydrotreater units.

4. The method as claimed in claim 1, wherein the second top product from the second intermediate separator column is routed to at least one of product treatments units and the secondary processing unit.

5. The method as claimed in claim 1, wherein the heavier bottom product are passed to secondary processing units.

6. The method as claimed in claim 5, wherein a single stream is withdrawn from the second intermediate separator column and passed to the secondary processing units.

7. The method as claimed in claim 1, wherein the product fractions comprise off-gas with LPG and naphtha, Kerosene, Light Coker Gas Oil (LCGO), Heavy Coker Gas Oil (HCGO), and heavy bottom product.

8. The method as claimed in claim 1, wherein the heavy bottom product from the main fractionator is routed to the second intermediate separator.

9. The method as claimed in claim 1, wherein the heavier bottom product are withdrawn from the second intermediate separator and passed to secondary processing units, wherein the secondary processing units comprises at least one of fluid catalytic cracking, hydrocracker, and/or hydrotreater units.

10. The method as claimed in claim 1, wherein the pre-cracking reactor operates at the desired temperature in the range of 350 to 470° C. and the pressure in the range of 1 to 15 $Kg/cm^2$ (g).

11. The method as claimed in claim 1, wherein feedstock within the pre-cracking reactor has a residence time in the range of 1 to 40 minutes.

12. The method as claimed in claim 1, wherein the first intermediate separator is operated at a pressure in the range of 1 to 6 $Kg/cm^2$ (g).

13. The method as claimed in claim 1, wherein the first intermediate separator is operated at a bottom temperature in the range of 300 to 400° C.

14. The method as claimed in claim 1, wherein the second intermediate separator column is operated at a pressure in the range of pressure of 10 to 200 mmHg.

15. The method as claimed in claim 1, wherein the second intermediate separator column is operated at a bottom temperature in the range of 200 to 350° C.

16. The method as claimed in claim 1, wherein the coke drum is operated at a temperature in the range of 470 to 520° C. and a pressure in the range of 0.5 to 5 $Kg/cm^2$ (g).

17. The method as claimed in claim 1, wherein feedstock within the coke drum is provided with a residence time of more than 10 hours for thermal cracking reactions.

18. The method as claimed in claim 7, wherein the heavy bottom product is Coker Fuel Oil (CFO).

19. A method of reducing overall coke yield in a delayed coking process, said method comprising the steps of:

a) heating a hydrocarbon feedstock in a furnace to obtain a hot feed at a desired inlet temperature of a pre-cracking reactor;

b) passing the hot feed at the desired inlet temperature and a pressure to the pre-cracking reactor, wherein the hot feed undergoes mild thermal cracking reactions to obtain an outlet product material stream;

c) introducing the outlet product material stream to a first intermediate separator to split hydrocarbons in the outlet material stream into a first top product and bottom fractions;

d) routing the first top product to a main fractionator;

e) separating the bottom fractions in a second intermediate separator column operating at vacuum conditions to obtain a second top product, a heavier bottom product and a heavy bottom material, wherein the heavy bottom product comprises of Coker Fuel Oil (CFO);

f) passing the second top product obtained in step (e) to the main fractionator;

g) withdrawing the heavier bottom product from the second intermediate separator of step (e) and passing to the main fractionator, wherein the heavier bottom product comprises Light Vacuum Gas Oil (LVGO) and Heavy Vacuum Gas Oil (HVGO);

h) heating the heavy bottom material in a furnace to a desired coking temperature to obtain a hot hydrocarbon stream;

i) passing the hot hydrocarbon stream from the furnace to a preheated coke drum; and j) passing product vapors exiting the coke drum to the main fractionator column to obtain product fractions.

* * * * *